US007559551B2

(12) United States Patent
Chikumoto

(10) Patent No.: US 7,559,551 B2
(45) Date of Patent: Jul. 14, 2009

(54) PAPER DISCHARGE DEVICE USING ELASTIC MATERIAL AND PRESSING ACTION FOR PRINTER

(75) Inventor: Kouichi Chikumoto, Osaka (JP)

(73) Assignee: Funai Electric Co., Ltd. (JP)

( * ) Notice: Subject to any disclaimer, the term of this patent is extended or adjusted under 35 U.S.C. 154(b) by 177 days.

(21) Appl. No.: 11/085,566

(22) Filed: Mar. 22, 2005

(65) Prior Publication Data

US 2005/0242495 A1 Nov. 3, 2005

(30) Foreign Application Priority Data

Apr. 28, 2004 (JP) ..... 2004-132692

(51) Int. Cl.
*B65H 29/20* (2006.01)

(52) U.S. Cl. ..... 271/314; 271/264

(58) Field of Classification Search ..... 271/264, 271/145, 314

See application file for complete search history.

(56) References Cited

U.S. PATENT DOCUMENTS 4,251,067 A * 2/1981 Mitzel ..... 271/196
4,465,272 A * 8/1984 Kajita et al. ..... 271/246
4,887,133 A * 12/1989 Ikeda et al. ..... 399/124
4,908,662 A * 3/1990 Yamamoto et al. ..... 399/185
5,000,596 A * 3/1991 Naruki ..... 400/625
5,083,766 A * 1/1992 Osawa ..... 271/121
5,292,112 A * 3/1994 Hirota et al. ..... 271/3.03
5,436,715 A * 7/1995 Yamada et al. ..... 399/364
5,441,251 A * 8/1995 Ohta ..... 271/145
6,010,125 A * 1/2000 Nakajima ..... 271/11
6,217,019 B1 * 4/2001 Ishiduka et al. ..... 271/147
6,412,772 B1 * 7/2002 Itoh et al. ..... 271/145

FOREIGN PATENT DOCUMENTS

JP 61-130442 8/1986
JP 63-102452 5/1988
JP 02-032880 * 2/1990
JP 06-36850 5/1994
JP 61-31840 5/1994
JP 61-72553 6/1994
JP 08-108590 4/1996

(Continued)

*Primary Examiner*—Patrick H Mackey
*Assistant Examiner*—Gerald W McClain
(74) *Attorney, Agent, or Firm*—Bacon & Thomas, PLLC

(57) ABSTRACT

A paper discharge device for a printer according to the present invention includes a paper guide 4 that has a paper holding end 41 for pressing paper P against a paper guide surface 3 at a nip at a longitudinally intermediate position A of the paper guide surface 3 in front of a paper feed roller 1 while the paper P passes through the nip in the feed direction "a". The paper guide 4 is formed by a resin plate piece, one surface of the plate piece being utilized as a paper discharge surface 42. An extension portion 43 of the plate piece is provided opposite and below a paper discharge roller 5 to bias the paper P running on to the paper discharge surface 42 into contact with the circumferential surface 51 of the paper discharge roller 5 by its elasticity. Thus, one surface of the paper guide is utilized as a paper discharge surface, and the paper guide is also used as a paper pressing member for pressing paper against the paper discharge roller.

6 Claims, 3 Drawing Sheets

FOREIGN PATENT DOCUMENTS

| | | |
|---|---|---|
| JP | 08-259030 | 10/1996 |
| JP | 09-040257 | 2/1997 |
| JP | 10-083081 | 3/1998 |
| JP | 2001-260467 | 9/2001 |
| JP | 2004-020763 | 1/2004 |

* cited by examiner

PAPER DISCHARGE DEVICE USING ELASTIC MATERIAL AND PRESSING ACTION FOR PRINTER

BACKGROUND OF THE INVENTION

1. Field of the Invention

The present invention relates to a paper discharge device for a printer, and more particularly to a paper discharge device for a printer adapted to bring paper into elastic contact with a paper discharge roller to apply a carrying force to the paper in the discharge direction.

2. Description of the Prior Art

In FIG. 4 is shown a schematic side elevational view of a conventional paper discharge device. In the paper discharge device shown in the figure, on the upper surface of a base member 2 with a paper feed roller 1 mounted thereon is formed a paper guide surface 3 for guiding paper, which is fed by the paper feed roller 1 in the feed direction (forward) "a", slidingly toward a print section (not shown in the figure). Extending from a bearing portion 21 of the base member 2, which rotatably supports a spindle 12, in turn supporting the paper feed roller 1, through a longitudinally intermediate position A of the paper guide surface 3, is a paper guide plate 4 with the rear portion thereof raised, the front end portion of the paper guide 4 being brought into elastic contact with the paper guide surface 3 as a paper holding portion 41. Also, a paper discharge roller 5 is provided above the paper feed roller 1, and above the paper discharge roller 5 is provided a paper pressing member 6 in the form of a plate spring, etc., the paper pressing member 6 being brought downward into elastic contact with the circumferential surface 51 of the paper discharge roller 5 by the elasticity thereof. Further, one surface (upper surface) of the paper guide 4 is formed as a paper discharge surface 42 that receives paper carried through on the paper guide surface 3 in front of the paper holding portion 41 in the discharge direction (rearward) "b", opposite to the feed direction "a".

In a printer equipped with the paper discharge device having the arrangement above, paper fed by the paper feed roller 1 is held between the paper guide surface 3 and the paper holding portion 41 formed in the front end portion of the paper guide 4 at the longitudinally intermediate position A on the paper guide surface 3, in front of the paper feed roller 1, while the paper passes therethrough in the feed direction "a" to the print section. After printing in the print section, the paper is carried through on the paper guide surface 3 in front of the paper holding portion 41 in the discharge direction "b". Then, the paper P carried through on the paper guide surface 3 in the discharge direction "b" is raised up by the paper holding portion 41 to run on to the paper discharge surface 42, and subsequently introduced between the paper discharge roller 5 and the paper pressing member 6. Therefore, the paper P is brought downward into elastic contact with the circumferential surface 51 of the paper discharge roller 5 by the elasticity of the paper pressing member 6, and then a carrying force in the discharge direction "b" is applied to the paper P by the paper discharge roller 5 to discharge the paper P rearward.

In such a paper discharge device, in the case where a single motor (not shown in the figure) is used as a rotary drive source for the paper feed roller 1 and the paper discharge roller 5, to limit the required number of motors to one, two examples as shown in FIGS. 5 (A) and 5 (B) can be cited as a transmission mechanism for operating the paper feed roller 1 and the paper discharge roller 5 simultaneously. In the transmission mechanism shown in FIG. 5 (A), a relay gear 73 is provided between an input gear 71 on the side of the paper feed roller 1 and an output gear 72 on the side of the paper discharge roller 5, whereby the paper feed roller 1 and the paper discharge roller 5 are adapted to rotate in the same direction (R1 and R2) respectively to feed and discharge paper without switching the rotational direction of the motor. Meanwhile, in the transmission mechanism shown in FIG. 5 (B), the input gear 71 on the side of the paper feed roller 1 and the output gear 72 on the side of the paper discharge roller 5 are engaged directly with each other, whereby the paper feed roller 1 and the paper discharge roller 5 are adapted to rotate in the opposite directions R1 and R2 respectively to select the feed mode or the discharge mode alternatively by switching the rotational direction of the motor. It is noted that the arrow R1' indicates the rotational direction of the input gear 71 on the side of the paper feed roller 1 in the feed mode, while the arrow R2' indicates the rotational direction of the output gear 72 on the side of the paper discharge roller 5 in the feed mode.

Examples of the many paper discharge devices in which paper is brought into elastic contact with a paper discharge roller using a member corresponding to the paper pressing member 6 shown in FIG. 4, and then the paper discharge roller is rotated to apply a carrying force to the paper in the discharge direction, are disclosed in Japanese Utility-Model Laid-Open Publication No. Sho 61-130442, Japanese Patent Laid-Open Publication No. Hei 2-32880, and Japanese Utility-Model Laid-Open Publication No. Hei 6-36850.

However, in the prior art examples shown in FIG. 4 and in the above-mentioned documents, wherein paper is brought into elastic contact with the paper discharge roller 5 using the paper pressing member 6 or a member corresponding thereto, and then the paper discharge roller 5 applies a carrying force to the paper in the discharge direction, requires the paper pressing member 6 or the member corresponding thereto as an additional element, resulting in a cost increase and in a problem in that it is necessary to ensure an additional space for installing the paper pressing member 6, thereby preventing reduction in the size of the paper discharge device.

Also, in the case in the prior art, where with the paper P is introduced over the paper discharge roller 5 and brought downward into elastic contact with the circumferential surface 51 of the paper discharge roller 5 by the paper pressing member 6, the rotary drive source for the paper feed roller 1 and the paper discharge roller 5 is limited to one motor, it is necessary to provide the relay gear 73 between the input gear 71 on the side of the paper feed roller 1 and the output gear 72 on the side of the paper discharge roller 5, shown in to FIG. 5 (A), to feed and discharge paper without switching the rotational direction of the motor, resulting in an increase in the number of required parts and thereby in an increase in the cost and in a problem in that it is necessary to provide an additional space for installing the relay gear 73, preventing the reduction of the size of the paper discharge device. On the other hand, selecting the feed mode and the discharge mode alternatively by switching the rotational direction of the motor suffers from a problem in that the controlling of the rotational direction of the motor becomes complicated.

SUMMARY OF THE INVENTION

The present invention has been made in consideration of the above-mentioned problems, and an object thereof is to provide a paper discharge device for a printer, in which one surface of a paper guide is utilized as a paper discharge surface for guiding paper in the discharge direction, and the paper guide is also used as a replacement for the paper pressing member 6 described in FIG. 4 to allow omission of paper pressing member 6 as an additional component.

It is another object of the present invention to provide a paper discharge device for a printer, in which in the case where a single motor is used as the rotary drive source for the paper feed roller 1 and the paper discharge roller 5, the arrangement of a transmission mechanism between the paper feed roller and the paper discharge roller for feeding and discharging paper, without switching the rotational direction of the motor, is simplified.

A paper discharge device for a printer according to the present invention has a base with a paper guide surface for holding paper fed by a paper feed roller, with a paper support plate inclined upward from a longitudinally intermediate position on the paper guide surface in front of the paper feed roller while the paper passes between a lower end of the paper support plate and the paper guide surface in the feed direction. The paper support plate is an elastic plate, one surface of the plate serving as a paper discharge surface that receives paper from the paper guide surface in the discharge direction opposite the feed direction. The paper support plate includes a paper pressing portion (extension portion) for biasing the paper running on to the paper discharge surface into contact with a paper discharge roller, thereby applying a carrying force to the paper in the discharge direction. A resin plate is preferably used for the plate piece.

In accordance with the above invention, the paper support plate includes the paper pressing portion, which is adapted to bias paper running on to the paper discharge surface into elastic contact with the discharge roller, by the elasticity of the paper support plate, whereby the function of the paper pressing member 6 described in FIG. 4 is instead provided by the paper pressing portion of the paper guide. Therefore, it is not necessary to use paper pressing member 6 as an additional component, resulting in a reduction of the number of parts.

Further in accordance with the above-described arrangement, the paper running on to the paper discharge surface is brought upward into elastic contact with the circumferential surface of the paper discharge roller, whereby in the case where a single rotary drive source for the paper feed roller and the paper discharge roller is required, it is possible to feed and discharge paper without switching the rotational direction of the motor by directly engaging an input gear on the side of the paper feed roller and an output gear on the side of the paper discharge roller. Therefore, it is not necessary to additionally use the relay gear 73 shown in FIG. 5 (A) as in the conventional paper discharge device, resulting in a reduction of the number of parts, and a reduction of the size of the paper discharge device. In addition, it is not necessary to select the feed mode or the discharge mode alternatively by switching the rotational direction of the motor as described with reference to FIG. 5 (B).

Thus, the paper discharge device according to the present invention includes a paper guide surface for holding paper fed by a paper feed roller, with a paper support plate inclined upward from a longitudinally intermediate position of the paper guide surface in front of the paper feed roller, while the paper passes between a lower end of the paper support plate and the paper guide surface in the feed direction. The paper support plate is a flat plate piece composed of an elastic resin, one surface of the plate serving as a paper discharge surface that receives paper from the paper guide surface in the discharge direction, opposite to the feed direction. The paper support plate extends inclined upwardly from the paper guide surface, above the paper feed roller with the rear portion thereof raised, and beyond a paper discharge roller as an extension portion The extension portion includes a paper pressing portion for biasing the paper running on to the paper discharge surface upward into elastice contact with the circumferential surface of the paper discharge roller, by the elasticity of the paper support plate.

As previously described, in accordance with the present invention, one surface of the paper support plate is utilized as the paper discharge surface for guiding paper in the discharge direction, and the paper support plate is also used as a replacement for the paper pressing member 6 described in FIG. 4 to negate need for the paper pressing member 6 as an additional part, resulting in a reduction of the number of parts, and it is not necessary to provide an additional space for installing the paper pressing member 6, which allows a reduction in the cost and size of the paper discharge device.

Further, in the case where the rotary drive source for the paper feed roller and the paper discharge roller is required to be a single motor, the transmission mechanism between the paper feed roller and the paper discharge roller for feeding and discharging paper without switching the rotational direction of the motor can be simplified easily.

BRIEF DESCRIPTION OF THE DRAWINGS

FIG. 5 (B) is a schematic side elevational view showing another example of a prior art transmission mechanism.

DESCRIPTION OF THE PREFERRED EMBODIMENTS

Figure 1:
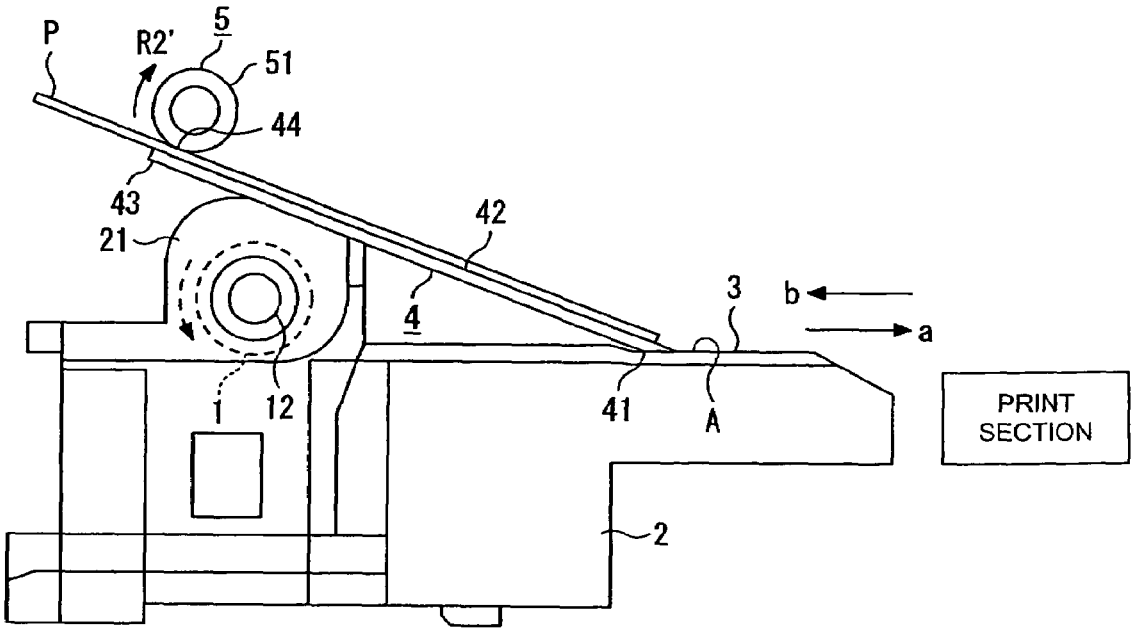
FIG. 1 is a schematic side elevational view of a paper discharge device for a printer according to the present invention.
Figure 4:
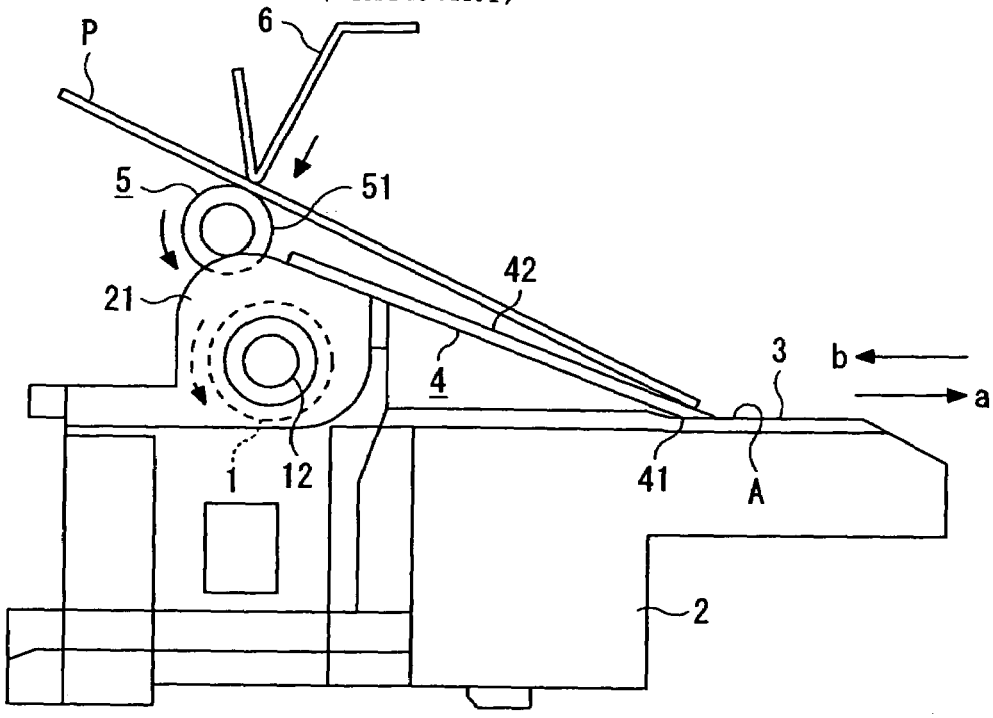
FIG. 4 (PRIOR ART)
FIG. 4 is a schematic side elevational view of a prior art device.
Figure 5:
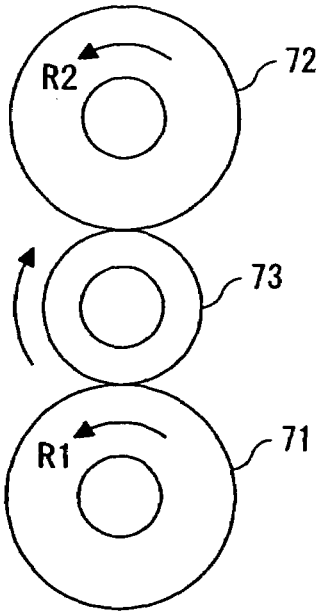
FIG. 5 (A) (PRIOR ART)
FIG. 5 (*a*) is a schematic side elevational view showing an example of a transmission mechanism employed in the prior art.
Figure 5:
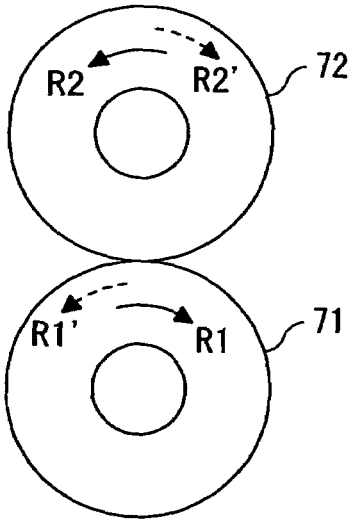
FIG. 5 (B) (PRIOR ART)

The paper discharge device shown in FIG. 1 has the same arrangement as the prior art example described in FIG. 4 in that on the upper surface of a base member 2 with a paper feed roller 1 mounted thereon is formed a paper guide surface 3 for guiding paper, which is fed in the feed direction (forward) "a" by the paper feed roller 1, slidingly toward a print section; that from a bearing portion 21 of the base member 2, which holds rotatably a spindle 12 supporting the paper feed roller 1, through a longitudinally intermediate position A of the paper guide surface 3 is arranged a paper guide 4 formed by a plate piece with the rear portion thereof raised, the front end portion of the paper guide 4 being brought into elastic contact with the paper guide surface 3 as a paper holding portion 41; that one surface (upper surface) of the paper guide 4 is formed as a paper discharge surface 42 that allows paper carried through on the paper guide surface 3 in front of the paper holding portion 41 in the discharge direction (rearward) "b" opposite to the feed direction "a" to run on thereto; and that a paper discharge roller 5 for applying a carrying force to the paper P running on to the paper discharge surface 42 in the discharge direction is provided.

Figure 2:
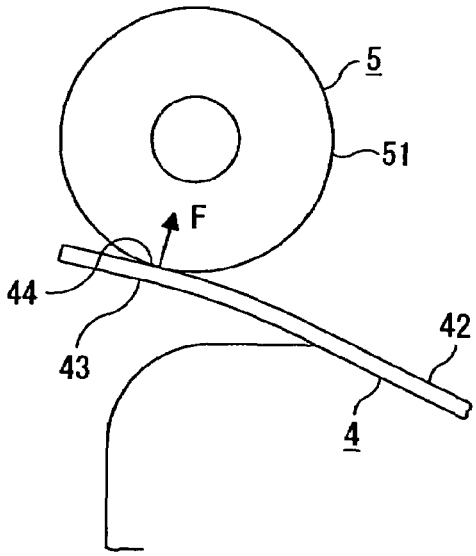
FIG. 2 is an enlarged view of a substantial part of the paper discharge device of FIG. 1.

The present embodiment is different from the prior art example described in FIG. 4 in that the paper pressing member 6 of the prior art example is removed to utilize the paper guide 4 instead. That is, in the present embodiment, the paper guide 4 is formed as an elastic resin plate, and the paper discharge roller 5 is provided above an extension portion 43 formed by extending the plate piece rearward beyond the bearing portion 21, the extension portion 43 including a paper pressing portion 44 for biasing the paper P running on to the paper discharge surface 42 upward into elastic contact with the circumferential surface 51 of the paper discharge roller 5. When no paper is present, the paper pressing portion 44 is biased upward into elastic contact with the circumferential surface 51 of the paper discharge roller 5 as shown in FIG. 2.

In the above-described paper discharge device, since the paper holding portion 41 at the front end of the paper guide 4 is brought into elastic contact with the paper guide surface 3, even in the case where multiple sheets of paper are carried in an overlapping manner on the paper guide surface 3, those overlapping sheets of paper are separated as they pass between the paper holding portion 41 and the paper guide surface 3. Therefore, the paper guide 4 provides the function of preventing paper from being carried in an overlapping manner.

In addition, when printed paper is carried on the paper guide surface 3 in the discharge direction "b", the paper runs onto the paper discharge surface 42 of the paper guide 4, and then the leading end of the paper P between the paper pressing portion 44 and the paper discharge roller 5 is pressed upward against the circumferential surface 51 of the paper discharge roller 5 by the elasticity of the extension portion 43 of the resin plate forming the paper guide plate 4. The pressing direction in this case is shown in FIG. 2 by the arrow F. Thus, a carrying force is applied to the paper P in the discharge direction by the rotation of the paper discharge roller 5 in the discharge direction (arrow R2'), and therefore the paper P pressed against the paper discharge roller 5 by the paper pressing portion 44 passes through the elastic contact area, that is, the nip between the paper discharge roller 5 and the paper pressing portion 44, and is thereby discharged rearward.

Figure 3:
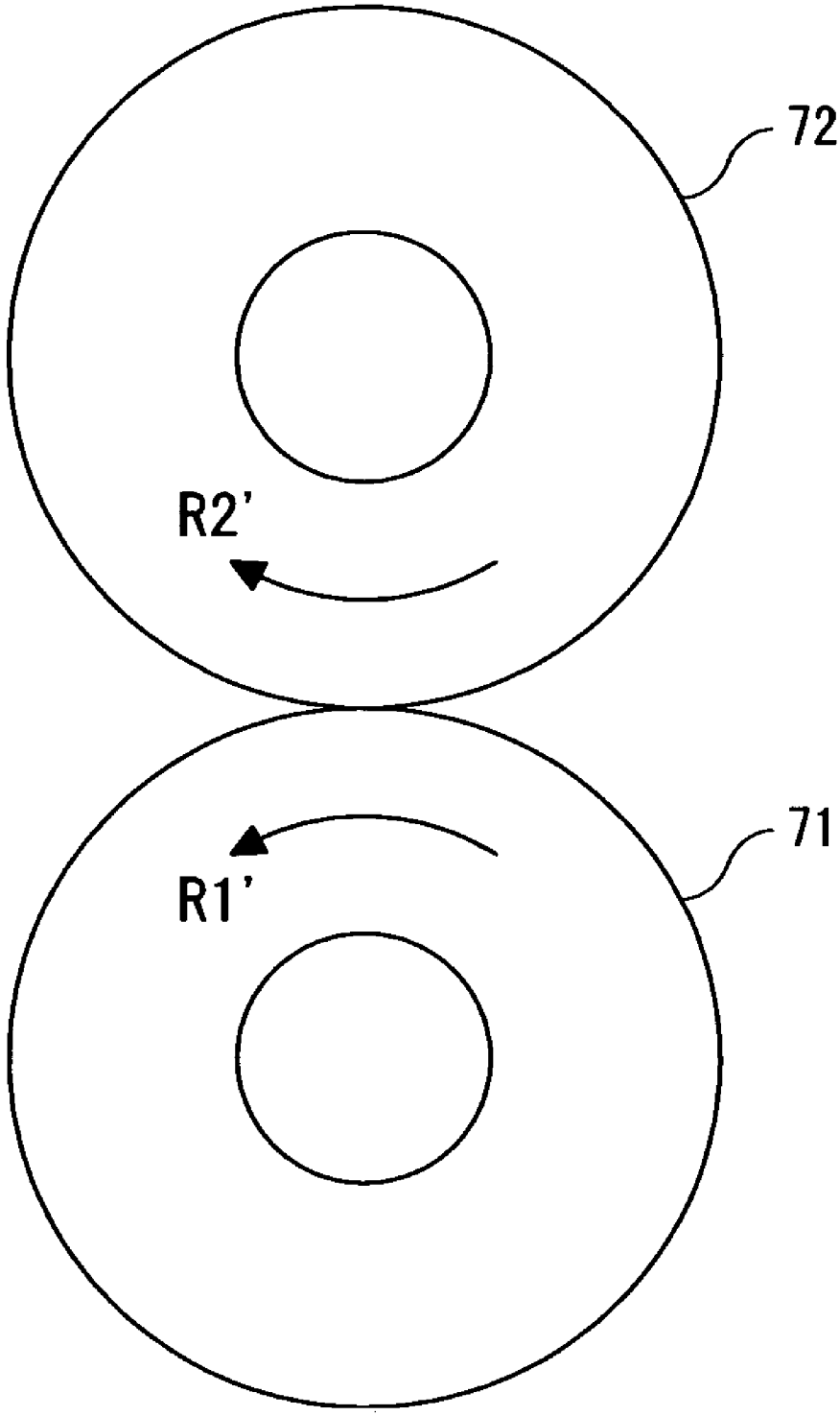
FIG. 3 is a schematic side elevational view showing an example of a transmission mechanism.

In such a paper discharge device, in the case where a single motor (not shown in the figure) is required as a rotary drive source for both the paper feed roller 1 and the paper discharge roller 5, to limit the required number of motors to one, the example shown in FIG. 3 can be employed as a transmission mechanism for operating the paper feed roller 1 and the paper discharge roller 5 simultaneously. In the transmission mechanism shown in FIG. 3, the paper feed roller 1 and the paper discharge roller 5 are adapted to rotate in the opposite directions of R1' and R2', respectively, by directly engaging an input gear 71 on the side of the paper feed roller 1 and an output gear 72 on the side of the paper discharge roller 5. With this transmission mechanism, it is possible to feed and discharge paper without switching the rotational direction of the motor. Therefore, no complicated control for selectively alternating between the feed mode and the discharge mode, by switching the rotational direction of the motor, is required.

The paper guide 4 may be provided horizontally, though with the rear portion thereof raised as in the present embodiment. The plate piece forming the paper guide 4 may be made of an elastic steel plate instead of a resin plate.

What is claimed is:

1. A paper discharge device for a printer, the paper discharge device discharging paper in a paper discharge direction along a paper discharge path, the paper discharge device comprising:

a base member providing an upper paper guide surface, extending from a first end adjacent a paper feed roller to a second end adjacent a print section, for supporting paper traveling thereon in a paper feeding direction, opposite the paper discharge direction;

a paper support plate inclined relative to the paper guide surface and extending upward from one end located at a longitudinally intermediate position on an upper surface of said paper guide surface, and in elastic contact therewith to form a paper holding portion through which the paper is passed in the paper feeding direction, to a distal end opposite the one end, the intermediate position on the paper guide surface being located spaced from the first and second ends, said paper support plate including an upper end portion between the paper feed roller and the distal end and an upper surface supporting the paper superimposed thereon and defining the paper discharge path as extending from the longitudinally intermediate position to the distal end; and a paper discharge roller arranged above and pressed against an upper surface of said upper end portion and deflecting said upper end portion relative to a remaining portion of the paper support plate via an elasticity of the upper end portion, to apply a carrying force to paper passing therebetween;

wherein the paper feed roller and the paper discharge roller rotate in opposite directions and are driven by a single motor directly engaging an input gear on a side of the paper feed roller and an output gear on a side of the paper discharge roller.

2. A paper discharge device according to claim 1 wherein the paper support plate is composed of an elastic resin material.

3. A paper discharge device according to claim 1 wherein said upper end portion is deflected at an angle relative to a remaining portion of said paper support plate.

4. A paper discharge device for a printer, the paper discharge device discharging paper in a paper discharge direction along a paper discharge path, the paper discharge device comprising:

a base member providing an upper paper guide surface, extending from a first end adjacent a paper feed roller to a second end adjacent a print section, for supporting paper fed by a paper feed roller;

a paper support plate inclined relative to the paper guide surface and extending upward from one end located at a longitudinally intermediate position on an upper portion of said paper guide surface, and in elastic contact therewith to form a paper holding portion through which the paper is passed from the paper feed roller in a paper feeding direction, opposite the paper discharge direction, to a distal end opposite the one end, the intermediate position on the paper guide surface being located spaced from the first and second ends, said paper support plate extending over the paper feed roller, said paper support plate, including a flat portion and an elastic upper end portion between the paper feed roller and the distal end, supporting the paper superimposed thereon, said elastic upper end portion extending from said flat portion to the distal end of said paper support plate, said paper support plate having an upper surface defining the paper discharge path as extending from the longitudinally intermediate position on the paper guide surface to said distal end; and a paper discharge roller arranged above and pressed against an upper surface of said elastic upper end portion and deflecting said elastic upper end portion relative to said flat portion via an elasticity of the upper end portion, to apply a carrying force to paper passing therebetween;

wherein the paper feed roller and the paper discharge roller rotate in opposite directions and are driven by a single motor directly engaging an input gear on a side of the paper feed roller and an output gear on a side of the paper discharge roller.

5. A paper discharge device according to claim 4 wherein the paper support plate is composed of an elastic resin material.

6. A paper discharge device according to claim 4 wherein said elastic upper end portion is deflected at an angle relative to said flat portion.

* * * * *